US007151464B2

(12) United States Patent
Ramus

(10) Patent No.: US 7,151,464 B2
(45) Date of Patent: Dec. 19, 2006

(54) DRIVE DEVICE WITH RADIO FREQUENCY CONTROL

(75) Inventor: Michel Ramus, Amancy (FR)

(73) Assignee: Somfy, Cluses (FR)

( * ) Notice: Subject to any disclaimer, the term of this patent is extended or adjusted under 35 U.S.C. 154(b) by 212 days.

(21) Appl. No.: 10/477,346

(22) PCT Filed: May 7, 2002

(86) PCT No.: PCT/FR02/01568

§ 371 (c)(1),
(2), (4) Date: Nov. 7, 2003

(87) PCT Pub. No.: WO02/097230

PCT Pub. Date: Dec. 5, 2002

(65) Prior Publication Data

US 2004/0162040 A1 Aug. 19, 2004

(30) Foreign Application Priority Data

Jun. 1, 2001 (FR) ..... 01 07249

(51) Int. Cl.
*G08C 19/00* (2006.01)

(52) U.S. Cl. ..... 340/825.72; 340/825.69

(58) Field of Classification Search ..... 340/825.72, 340/825.69, 870.17; 318/16, 261, 98; 361/42; 236/49.3; 160/3; 15/329; 343/901, 700 MS, 343/715, 905; 455/217; 725/79, 85; 174/70 R, 174/115, 66

See application file for complete search history.

(56) References Cited

U.S. PATENT DOCUMENTS

| | | | | |
|---|---|---|---|---|
| 2,218,830 A | | 10/1940 | Rose et al. | |
| 2,581,983 A | | 1/1952 | Thompson | |
| 2,915,627 A | | 12/1959 | Spindler | |
| 3,290,601 A | | 12/1966 | Pinizzotto et al. | |
| 3,649,742 A | * | 3/1972 | Tissot | 174/70 R |
| 3,863,157 A | | 1/1975 | Quinlan et al. | |
| 3,938,046 A | * | 2/1976 | Valdettaro | 455/217 |
| 4,032,723 A | | 6/1977 | Mendoza | |
| 4,194,178 A | * | 3/1980 | Dumbeck | 340/870.17 |
| 4,507,646 A | | 3/1985 | Hamlin et al. | |
| 5,103,146 A | * | 4/1992 | Hoffman | 318/16 |
| 5,151,838 A | * | 9/1992 | Dockery | 725/79 |
| 5,351,284 A | | 9/1994 | Rogers | |
| 6,104,920 A | | 8/2000 | Llewellyn et al. | |
| 6,195,050 B1 | * | 2/2001 | Kim | 343/700 MS |
| 6,364,211 B1 | * | 4/2002 | Saleh | 236/49.3 |

(Continued)

FOREIGN PATENT DOCUMENTS

EP 0 921 266 A3 6/1999

(Continued)

OTHER PUBLICATIONS

PCT International Search Report.

*Primary Examiner*—Wendy R. Garber
*Assistant Examiner*—William Bangachon
(74) *Attorney, Agent, or Firm*—Welsh & Katz, Ltd.

(57) ABSTRACT

A drive device with radiofrequency control includes a motor, a radiofrequency receiver for receiving radiofrequency signals and for controlling the motor. Electrical conductors provide power for both the motor and the radiofrequency circuit. The antenna is connected to the radiofrequency receiver and is non-galvanically electrically coupled one of the conductors at radiofrequencies. The control circuit receives radiofrequency signals directly through the antenna or via radiofrequency coupling from one of the power supply conductors. The device has increased ability to receive radiofrequency signals independent of its environment.

13 Claims, 2 Drawing Sheets

U.S. PATENT DOCUMENTS 6,693,778 B1 * 2/2004 Pittman et al. ..... 361/42

FOREIGN PATENT DOCUMENTS

| | | |
|---|---|---|
| FR | 590 688 | 6/1925 |
| FR | 2 743 390 | 7/1997 |
| GB | 340389 | 1/1931 |
| GB | A-702525 | 4/1951 |

* cited by examiner

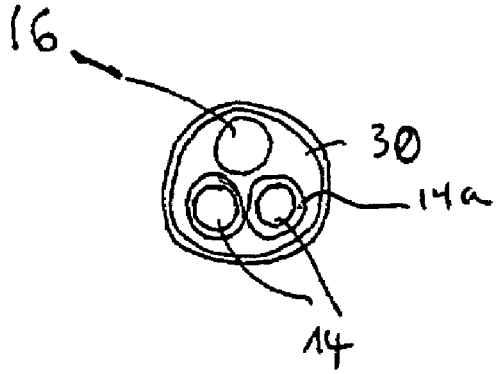
Fig. 3
FIG_2
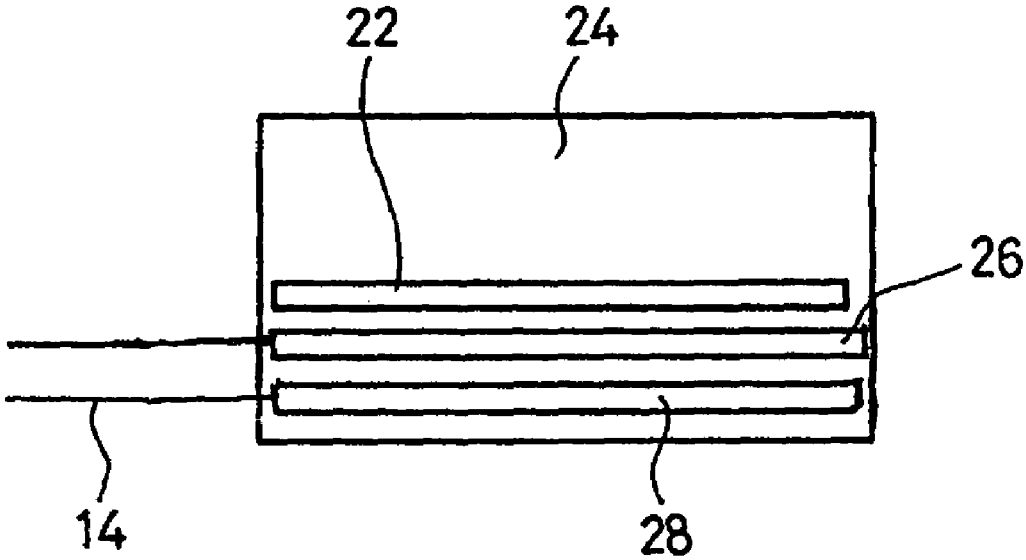

DRIVE DEVICE WITH RADIO FREQUENCY CONTROL

FIELD OF THE INVENTION

The present invention relates to radiofrequency controlled drive devices, more specifically drive devices used to wind blinds and roller shutters.

BACKGROUND OF THE INVENTION

In the field of housing or of building in general, radio transmission is being used increasingly frequently in order to remotely control elements electrically powered by the line supply (typically 230 V AC 50 Hz or 120 V AC 60 Hz), or the mains.

The applicant is marketing, under the reference SLT and IPSO, a motor for driving blinds or roller shutters, with radio remote control. This motor is of tubular shape and is placed inside a winding tube made of steel, on which the product to be wound is placed. Under these conditions, the radio integrated with the motor has an antenna in the form of a semirigid wire cord, coming out of the tubular motor and also coming out of the winding tube over a suitable distance, for example $\lambda/4$ (a quarter wavelength), that is 17 cm for a frequency of 433 MHz or about 8 cm for a frequency of 868 MHz.

This type of antenna has the drawback of being fragile, relative to the weight of the motor, which entails particular precautions with handling and packaging. Furthermore, the housing for the winding tube of the blind or roller shutter often consists of a steel, or even an aluminium, casing. In this unfavourable environment, the range of the antenna may be considerably reduced. Furthermore, if the device is externally mounted on a reinforced concrete wall this reduction is more pronounced.

It should be noted that various solutions have been proposed to make it easy to integrate a radio receiver with such a motor. Thus EP-0-921 266-A2 discloses direct placement of the radio receiver inside the motor tube. No explicit mention is made of the arrangement of the antenna. In the product marketed by TOPELECTRO International, in Spain, under the reference TOPELECTRO JUNIOR, the quarter-wave antenna is arranged completely independently of the line cord or mains lead, partially wound over itself so as to take up less space. This arrangement describes an extremely limited range.

In patent FR-2 743 390, the radio receiver is placed in a control box independently of the motor tube, but with easy integration with the roller shutter casing or with a blind fastening. No mention is made whatsoever of a particular arrangement for the antenna within this box.

In separate applications, it has also been proposed to use the power supply cable from the mains as mechanical support for an antenna. Examples of radio-controlled devices having an antenna lying along the mains power supply cable, but without mains coupling, are proposed in U.S. Pat. No. 2,218,830, GB-A-340 389, U.S. Pat. No. 6,104,920, U.S. Pat. No. 5,351,284 or else U.S. Pat. No. 3,863,157. U.S. Pat. No. 2,218,830 provides an antenna for a radio or television receiver, having an antenna formed by a wire associated with the power supply cable. The antenna is associated with this cable so as to minimize the coupling between the antenna and the line cord or mains lead. The benefit is then to have a nondirectional antenna of a length properly calibrated by the manufacturer. Thus, adjustment of the HF circuit does not depend on variable parameters, as is the case with an external antenna left to the initiative of the installer. GB-A-340 389 proposes, for such receivers, directly using a portion of the mains cable, isolated upstream and downstream by two terminator circuits, as an antenna. At the frequency of the signal, everything takes place as if the cable was a single wire acting as an aerial cord. Both terminators provide isolation between the signals received by the cable acting as an antenna and the mains signals. FIG. 4 of U.S. Pat. No. 6,104,920 provides a device of the same type as this British patent. GB-A-702 525 provides a solution of the same type for television receivers. The signal received over the part of the power supply conductors forming an antenna is coupled in the receiver by means of a coupling coil and a coaxial cable.

U.S. Pat. No. 5,351,284 concerns the base unit of a wireless telephone. The telescopic antenna is replaced by a wire coupled either to the telephone line, or to the mains lead, and; it is expressly stated that the telephone line or the mains lead does not contribute to the antenna reception. U.S. Pat. No. 3,863,157 provides a device of the same type, in which the connection wires between the amplifier of a stereo receiver and the loudspeakers are also used as antenna wires. Provision; is again made for separation of both functions. In all these documents, the objective sought is to replace a fragile or unsightly aerial with a portion of a cable which is used for other purposes. Consequently, these documents specify that it is important to isolate the signals received on the cable acting as an aerial from the signals transmitted on the cable in normal use.

U.S. Pat. No. 4,032,723 shows a cordless duplex telephone system where one of the elements of a doublet antenna consists of a conductor from the mains cable. The teaching of this document is similar to that of the previous documents—the antenna however being of another type.

Moreover, it has been proposed to use the mains as a receiving antenna. BUBENDORFF markets, under the reference "id", a motor for roller shutters with an integral radio not having a specific antenna, for which the mains is generally used as a receiving antenna, and using an electrical connection via a capacitor between the inlet terminal of a line cord or mains lead and the RF input point of the receiving circuit. It should be noted that such an arrangement makes the electronic card particularly sensitive to disruption from high-energy interference conveyed by the mains.

For other fields of the prior art, similar teaching appears in documents U.S. Pat. No. 2,581,983, U.S. Pat. No. 3,290,601, U.S. Pat. No. 2,915,627 or else U.S. Pat. No. 4,507,646. U.S. Pat. No. 2,581,983 discloses coupling a radiofrequency receiving circuit with the mains power supply cable of a radio receiver. The coupling point is separated by a quarter or an eighth wavelength from the receiver frame, which is connected to earth. U.S. Pat. No. 3,290,601 is an improvement to this patent, and proposes simply to form a doublet antenna by associating a single pole antenna with the previous device. U.S. Pat. No. 2,915,627 provides an antenna for a radio receiver. A cylindrical conductor having a length between a quarter and half wavelength of the radiofrequency signals surrounds the power supply cable. The cylindrical conductor allows the radiofrequency signals received by the mains, which acts as an antenna, to transmit to a radiofrequency receiver. U.S. Pat. No. 4,507,646 discloses using the wires of the mains as antenna for the transmitter or the receiver for a paging system. The; the nature of the circuit coupling the radiofrequency receiver or transmitter to the mains is not specified.

The devices described in these various documents have the objective of avoiding the use of a dedicated antenna, by using the mains conductors as an antenna.

This solution involves accurately controlling the point coupling the radiofrequency receiver or transmitter to the mains conductors. Without; such control of the coupling point, this solution in fact has serious drawbacks in terms of selectivity and of susceptibility to broadband high-energy interference conveyed by the mains. Furthermore, the galvanic isolation may entail the use of particularly well-protected capacitors.

In the special case of tubular motors, the invention provides a solution which makes it possible to control a motor by radio, with good reliability. The solution is applicable to all the use environments for these motors, and it is simple to implement.

SUMMARY OF THE INVENTION

More specifically, the invention provides a drive device having a motor, a radiofrequency circuit for controlling the motor, electrical conductors for powering the motor and the radiofrequency circuit and an antenna connected to the radiofrequency circuit and electrically coupled, for the radiofrequencies, to at least one of the conductors by non-galvanic coupling.

Advantageously, the power received or transmitted in part directly through the antenna represents more than 5%, or even 10%, of the power received or transmitted by the radiofrequency circuit.

Preferably, the power received or transmitted in part directly through the antenna represents less than 50%, or even less than 40%, of the power received or transmitted by the radiofrequency circuit.

In one embodiment, the antenna is mechanically coupled to the conductors. The antenna may be a monopole antenna, and, in this case, it may have a length close to a quarter wavelength of the radiofrequency signals received or transmitted by the radiofrequency circuit.

In another embodiment, the device has a motor tube in which the motor, the radiofrequency circuit and the antenna are placed. This tube is, for example, made of metal.

Provision may also be made for the antenna to be formed by a track of a printed circuit. In this case, it is advantageous that at least one conductor has a printed circuit track lying parallel to the track forming the antenna.

Other features and advantages of the invention will become apparent on reading the following description of embodiments of the invention, given by way of example and with reference to the appended drawings.

BRIEF DESCRIPTION OF THE DRAWINGS

FIG. 2, a partial schematic view of another embodiment of a drive device; and FIG. 3, a sectional end view of a motor tube showing conductors, antenna and insulating sheath.

DETAILED DESCRIPTION OF THE INVENTION

Figure 1:
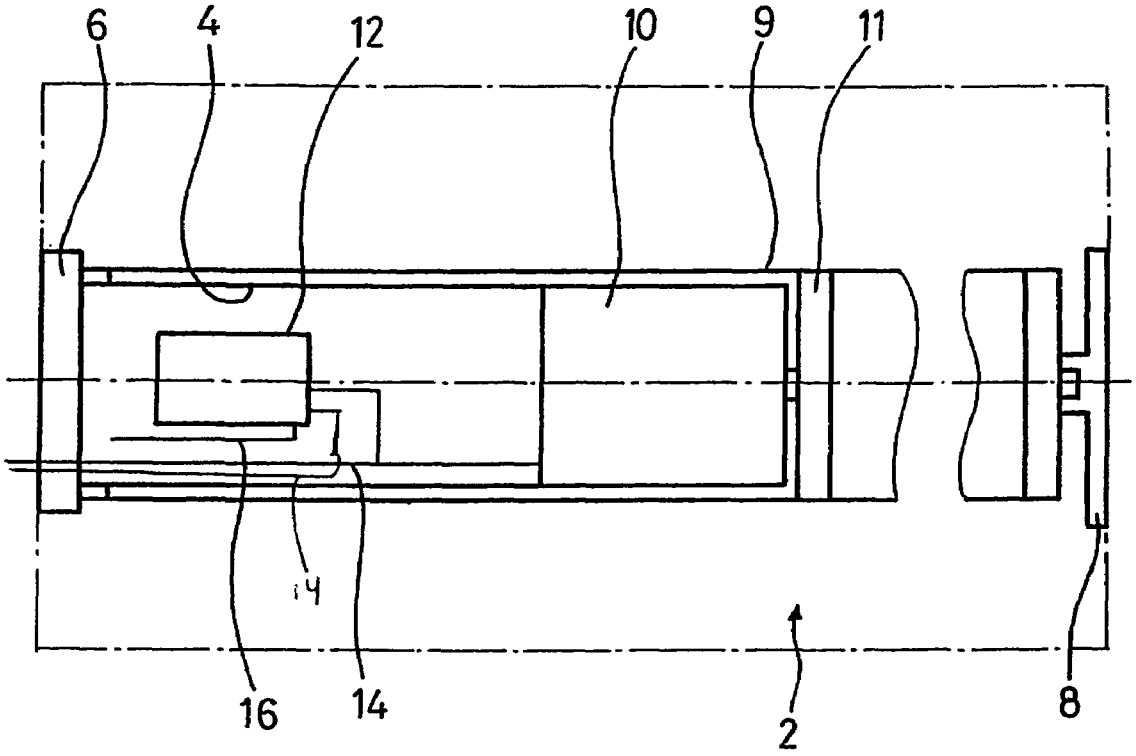
FIG. 1, a schematic sectional view of a drive device according to the invention.

The invention proposes, for radio control of a motor, using a monopole antenna and coupling this antenna to the electrical conductors powering the motor, by non-galvanic coupling; the antenna is thus coupled to the conductors for the radiofrequencies, but is isolated from the conductors at the frequency of the supply currents. As such, the radiofrequency power transmitted or received is transmitted or received:

partly by the antenna, which acts as a conventional antenna;

partly through the mains, which acts as an antenna.

The invention differs from the solution of the prior art described in U.S. Pat. No. 2,218,830 or in similar documents. This is because the antenna is electrically coupled to the electrical power supply conductors, such that the radiofrequency signals are at least in part received or transmitted through the mains power supply conductors. This configuration is especially advantageous when the motor is in a casing made of steel or of aluminium, which may limit the propagation of the electromagnetic waves.

The invention also differs from the solution of the prior art proposed in U.S. Pat. No. 2,581,983 or in similar documents; this is because, in these documents, provision is not made for an antenna directly receiving or transmitting part of the radiated or transmitted power. Since the invention is not based solely on the mains, it ensures more efficient reception or transmission.

The solution of the invention makes it possible to solve the problems of the motors of the prior art. Since the antenna is electrically coupled to the mains wires, it is possible to place the antenna inside a metal tube containing the motor and its control circuit. The antenna therefore does not go beyond the tube, and does not risk being damaged during transport or assembly.

FIG. 1 shows a schematic sectional view of a drive device according to a first embodiment of the invention. The device 2 has a tube 4, or motor tube. The motor tube is typically of cylindrical shape. It is often made of metal, which provides the necessary mechanical rigidity; it may also be made of plastic. A winding tube 9, most often made of metal, is provided around the motor tube. This winding tube is mounted on two supports 6 and 8, the support 6 being at one of the ends of the tube 4. The two supports include a bearing facilitating the rotation of the winding tube. This tube 9 accommodates the end of the roller or of the blind to be wound.

An electric motor 10, which is capable of rotating the winding tube 9 with respect to the motor tube 4 using a drive wheel 11, is provided inside the motor tube 4. The device further comprises, still inside the motor tube 4, a radiofrequency circuit 12 for controlling the motor. This circuit is capable of receiving or of transmitting radiofrequency signals, as explained below. Here, the term "radiofrequency" refers to the frequency ranges between 100 and 1000 MHz, with transmission through air over short distances—of the order of 10 to 1000 m in a free field.

The circuit 12 controls the motor as a function of the signals received and/or of the signals transmitted. The motor and the radiofrequency circuit are supplied with power by conductors 14 intended to be connected to the line or mains supply.

The device further has an antenna 16. This antenna is, on the one hand, connected to the radiofrequency circuit, such that the radiofrequency signals received by the antenna be applied to the circuit and/or such that the radiofrequency signals supplied by the circuit may be radiated by the antenna. The antenna is typically a quarter-wave antenna, formed from an elongate conductor having a length of about a quarter wavelength of the frequency used for controlling the motor; the common frequency ranges for home automation applications are 433 MHz or 868 MHz, which leads to an antenna length of about 17 or 8 cm. In the simplest version, the antenna will be a monopole antenna. As shown in the figure, the antenna lies completely within the motor tube 4; this has the advantage that the antenna is thus protected by the tube. The problems of fragility of the antenna or of installing the latter no longer present themselves.

The antenna 16 is also electrically coupled to at least one of the electrical conductors 14 powering the motor and the power circuit. The electrical coupling between the conductor or conductors 14 and the antenna 16 allows the radiofrequency circuit to receive, through the antenna, radiofrequency signals picked up by the line or mains supply; the network may therefore act as an antenna for receiving radiofrequency signals intended for the control circuit of the motor. Conversely, the electrical coupling between the conductor or conductors 14 and the antenna 16 allows the radiofrequency circuit to transmit radiofrequency signals towards the line or mains supply through the antenna 16; the line or mains supply may therefore act as a transmission antenna for radiofrequency signals transmitted by the control circuit of the motor.

The coupling between the antenna and the conductor or conductors 14 is a coupling which is both non-galvanic and selective; in other words, the antenna and the conductor are electrically coupled for signals within radiofrequency ranges used to control the motor; however, at the electrical frequencies powering the motor, 50 Hz and 60 Hz and related harmonics, the antenna and the conductors are isolated. This non-galvanic coupling may take place in various ways; the simplest is, as shown in FIG. 1, that the antenna lies close to the conductors; the distance between the conductor or conductors and the antenna may be as small as possible and correspond simply to the thickness of the isolator (typically rubber or plastic) surrounding the conductors; this configuration has the advantage of maximizing the coupling between the antenna and the conductors for the radiofrequencies.

As shown in FIG. 3 included are the two conductors 14, each having a layer of known insulation 14*a*, and an antenna 16. The antenna 16 is in close proximity to the conductors 14 physically separated by the thickness of the insulation 14*a* on the conductor. It is also possible for the antenna to be "mechanically" or "proximity" coupled to the conductors. This facilitates mounting of the drive device. A simple method consists in routing the conductors 14 and the antenna 16 through a heat shrinkable, insulating sheath 30, which applies mild compression to maintain the antenna 16 and conductor in close physical proximity. Such mechanical coupling ensures good proximity of the conductors and of the antenna, and therefore good electrical coupling at radiofrequencies. Accordingly, it can be seen that there is no galvanic coupling and that the antenna is not physically connected to or touching the actual conductor wire.

FIG. 1 also shows, in dotted lines, the limits of a casing 18 in which the drive device is placed; this casing is often a metal casing made of steel or of aluminum; it accommodates the winding tube together with the blind or roller shutter when the latter is in a folded position. The casing may then be completely closed; this is especially the case for casings of external blinds, which are closed when the blind is folded. In such a configuration, the antenna 16 is surrounded firstly by the motor tube 4, then by the winding tube 9, then by the casing; on the other hand, the conductors 14 come out of the motor tube and the casing, in order to be connected to the mains. It is however obvious that the exact position of the connection between the conductors 14 and the line or mains supply has no effect on the operation of the device.

The device of FIG. 1 operates as will now be explained. It may operate, on the one hand, in reception, for example for transmitting to the drive device an operating order—in the case of a blind or of a roller shutter, an order for winding or unwinding the blind, or else an order for stopping the winding or unwinding. On the other hand, it may operate in transmission, to transmit information relating to the state of the drive device—for example an acknowledgement of receiving a command, or else information on the position of the drive device or its speed; in this case, it is of course inappropriate to describe the circuit 12 as "control" circuit, since control of the motor may be carried out by other means; nevertheless, this term will be used for more simplicity in the present description. Operation in transmission and operation in reception are similar, and only the operation in reception will be described in detail.

In reception, radiofrequency signals are transmitted by a transmitter—for example a portable transmitter—to the drive device. These signals are, on the one hand, received directly by the antenna 16, and are therefore applied to the control circuit, in order to be decoded and executed therein. On the other hand, the signals are also received by the mains conductors—which act as an antenna. Because of the electrical coupling in the radiofrequency region between the conductors 14 and the antenna, the radiofrequency signals received by the conductors are transmitted to the antenna 16 and therefore applied to the control circuit. The latter therefore receives:

the signals directly received by the antenna 16, and the signals received by the supply conductors and coupled to the antenna 16.

The orders applied to the control circuit are transmitted by the latter to the motor, so as to rotate the winding tube in one direction or the other, or to stop its rotation.

The applicant has carried out reception tests for a drive device according to the invention, in relation to a device without electrical coupling of the antenna and of the supply conductor or conductors; during tests, the coupling was obtained by placing the antenna in the vicinity of the conductors, at a distance of 2 mm, over virtually the entire length (14 cm) of the antenna (17 cm); for a frequency of 433 MHz. The tests were carried out in a semi-anechoic chamber. They demonstrated that the proportion of signals received directly by the antenna or through the supply conductors depended on the orientation of the drive device. This proportion between:

the signals received directly by the antenna; and the total power received by the radiofrequency circuit varied between 3 and 40% with a mean of 21%. It is therefore preferable for this proportion to be greater than 5%, or even greater than 10%; this is ensured by the mere presence of the antenna. It is also preferable for this proportion to be less than 50%, or even 40%; this is ensured by the non-galvanic coupling between the antenna and the conductor or conductors. The more the winding tube limits the propagation of the radiofrequency waves, the more the proportion decreases; it also decreases if the winding device is in a metal casing. The terminals proposed ensure the correct operation under all the circumstances usually encountered in buildings.

By way of comparison, when comparing just the motors, which are identical except one (MA) of the antenna outside the steel tube 4, as already marketed by the applicant, and the other (MB) of the antenna according to the invention, the radiofrequency signals at the input of the control circuit have, in the second case, a power 10 dB less than the corresponding power in the first case; this reduction is representative of the reduction caused by the motor tube—the antenna being placed in the motor tube. The invention therefore has the effect of degrading the performance of a motor which is not yet installed.

On the other hand, when the device MB is inside a winding tube and a metal casing, corresponding to the typical conditions of use, the radiofrequency signals at the input of the control circuit have a power 3 dB greater than the corresponding power in a device MA also placed in a winding tube and a casing; this increase in power is representative of the effect of the non-galvanic coupling between the supply conductors and the antenna in the device of the invention.

FIG. 2 shows a partial schematic view of another embodiment. In the embodiment of FIG. 2, the antenna is in the form of a track 22 of a printed circuit 24. The coupling may then simply take place by using one or two tracks 26 or 28 close to the track forming the antenna for the conductor or conductors.

The device of the invention is noteworthy in that it avoids problems during the mounting of the device, during its installation and during its standard use.

Of course, the present invention is not limited to the examples and embodiments described and shown, but it is capable of many variants accessible to a person skilled in the art. It is thus possible to use configurations different from those of the figures, provided, for example, that the motor is delivered with the supply lead, which is not always the case. In such a situation, the lead would be made in a specific manner, and would contain, at the end to be connected to the motor, the antenna cord or a portion thereof. Such an arrangement would make it possible for the antenna to be at least partially outside the motor tube and/or the winding tube, and therefore for the control signal powers transmitted directly or via the supply wires to be better distributed. It is also possible for the antenna to lie outside the motor tube, even where the supply lead is delivered with the motor.

It is also clear that the invention is not limited to the preferred embodiment of roller shutters or blinds. It is more generally applicable to all drive devices, such as those of garage doors, armchairs or folding beds, or the like.

Specific embodiments of a drive device with radio frequency control according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A drive device for a home automation product having:

a motor;

a radiofrequency receiver for receiving radiofrequency signals and for controlling the motor;

electrical conductors for providing electrical power from a main power source to the motor and to the radiofrequency receiver;

an aerial antenna connected to the radiofrequency receiver configured to receive radiofrequency signals;

wherein a portion of the radiofrequency signals pass from at least one electrical conductor to the aerial antenna, the aerial antenna and the at least one conductor are electrically isolated at a frequency of the electrical power supplied to the motor and the radiofrequency receiver; and wherein a power level of radiofrequency signals received by the radiofrequency receiver due to radiofrequency coupling between the antenna and the at least one conductor is greater than 5% of total power of radiofrequency signals received by the radio frequency receiver.

2. The device of claim 1, wherein the a power level of radiofrequency signals received by the radiofrequency receiver due to radiofrequency coupling between the antenna and the at least one conductor is less than 50% of total power of radiofrequency signals received by the radio frequency receiver.

3. The device of claim 1, wherein the antenna is mechanically coupled to the at least one conductor.

4. The device of claim 1, wherein the antenna is a monopole antenna.

5. The device of claim 4, wherein the antenna has a length close to a quarter wavelength of the radiofrequency signals received by the radiofrequency receiver.

6. The device of claim 1, further including a motor tube in which the motor, the radiofrequency receiver and the antenna are placed.

7. The device of claim 6, wherein the tube is made of metal.

8. The device of claim 1, wherein the antenna is formed by a track of a printed circuit.

9. The device of claim 8, wherein the track forming the antenna lies parallel to a track on the printed circuit forming a portion of the at least one conductor.

10. The device of claim 1, wherein a power level of radiofrequency signals coupled into the antenna from the at least one conductor is less than 95% of total power of radiofrequency signals received by the radio frequency receiver.

11. The device of claim 1, wherein the a power level of radiofrequency signals coupled into the antenna from the at least one conductor is more than 50% of total power of radiofrequency signals received by the radio frequency receiver.

12. A drive device for a home automation product having:

a motor;

a radiofrequency circuit for receiving and transmitting radiofrequency signals and for controlling the motor;

electrical conductors for providing electrical power from a main power source to the motor and to the radiofrequency circuit;

an antenna connected to the radiofrequency circuit configured to receive and transmit radiofrequency signals;

wherein a portion of the radiofrequency signals pass from at least one electrical conductor to the antenna or from the antenna to the at least one electrical conductor, the antenna and the at least one conductor are electrically isolated at the frequency of the electrical power supplied to the motor and the radiofrequency circuit; and wherein a power level of radiofrequency signals received by the radiofrequency receiver due to radiofrequency coupling between the antenna and the at least one conductor is greater than 5% of total power of radiofrequency signals received by the radio frequency receiver.

13. A drive device for a home automation product including in a casing:

a motor;

a radiofrequency receiver for controlling the motor;

an aerial antenna connected to the radiofrequency receiver, the antenna configured to receive radiofrequency signals, electrical conductors for conveying electrical power from a source of AC power to the motor and to the radiofrequency receiver;

wherein the antenna and at least one conductor are electrically isolated at a frequency corresponding to the source of power, a first portion of radiofrequency signals pass through the casing and a second portion of radiofrequency signals pass between the at least one electrical conductor and the aerial antenna; and wherein a power level of radiofrequency signals received by the radiofrequency receiver due to radiofrequency coupling between the antenna and the at least one conductor is greater than 5% of total power of radiofrequency signals received by the radio frequency receiver.

* * * * *